US008375536B2

(12) United States Patent
Delecroix et al.

(10) Patent No.: US 8,375,536 B2
(45) Date of Patent: Feb. 19, 2013

(54) CIRCULAR NEEDLING MACHINE FED WITH A FIBER SHEET BY A CONVEYOR AND A VERTICAL CHUTE

(75) Inventors: Vincent Delecroix, Vernaison (FR); Marc Faron, Callian (FR)

(73) Assignee: Messier-Bugatti-Dowty, Velizy-Villacoublay (FR)

( * ) Notice: Subject to any disclaimer, the term of this patent is extended or adjusted under 35 U.S.C. 154(b) by 120 days.

(21) Appl. No.: 12/974,993

(22) Filed: Dec. 21, 2010

(65) Prior Publication Data

US 2011/0154628 A1 Jun. 30, 2011

(30) Foreign Application Priority Data

Dec. 22, 2009 (FR) ..... 09 59406

(51) Int. Cl.
*D04H 18/00* (2012.01)

(52) U.S. Cl. ..... 28/107

(58) Field of Classification Search ..... 28/107, 28/108, 109, 110, 111, 112, 113, 114, 115, 28/103, 125; 264/517, 113
See application file for complete search history.

(56) References Cited

U.S. PATENT DOCUMENTS 6,009,605 A * 1/2000 Olry et al. ..... 28/107
6,248,417 B1 * 6/2001 Ponsolle et al. ..... 428/66.2
6,347,440 B1 * 2/2002 Duval et al. ..... 28/107
6,363,593 B1 * 4/2002 Duval et al. ..... 28/107
7,185,404 B2 * 3/2007 Delecroix ..... 28/101
7,251,871 B2 * 8/2007 Delecroix et al. ..... 28/107
7,404,921 B2 * 7/2008 Duval ..... 264/517

FOREIGN PATENT DOCUMENTS

CA 2 238 835 C 6/1997
WO WO 02/088449 11/2002

OTHER PUBLICATIONS

Search Report as issued for French Patent Application No. 09/59406, dated Aug. 23, 2010.

* cited by examiner

*Primary Examiner* — Amy Vanatta
(74) *Attorney, Agent, or Firm* — Pillsbury Winthrop Shaw Pittman, LLP

(57) ABSTRACT

A circular needling machine for needling a textile structure formed from a helical fiber sheet, includes a needling table disposed beneath a feed table for feeding a helical fiber sheet for needling. The feed table includes a circular belt conveyor for receiving thereon a helical fiber sheet for needling, the conveyor being centered on a vertical axis and having a radial slot opening out under the circular conveyor to unwind continuously the fiber sheet received on the conveyor, the slot opening out under the conveyor towards a substantially straight chute that extends vertically between the conveyor and a support tray of the needling table centered on the vertical axis of the conveyor so as to take up the sheet unwound from the conveyor and bring it onto the needling table, the support tray having means for driving the fiber sheet in rotation about the vertical axis.

10 Claims, 6 Drawing Sheets

CIRCULAR NEEDLING MACHINE FED WITH A FIBER SHEET BY A CONVEYOR AND A VERTICAL CHUTE

CROSS-REFERENCE TO RELATED APPLICATIONS

This application is based upon and claims the benefit of priority from French patent application Ser. No. 09/59406, filed Dec. 22, 2009, the entire content of which is incorporated herein by reference.

BACKGROUND OF THE INVENTION

The present invention relates to the general field of circular needling machines for making needled textile structures, and more particularly it relates to automatically feeding such machines with fiber sheets.

It is known to make a circular type needling machine for fabricating annular textile structures for constituting the fiber reinforcement of annular parts made of composite material, in particular brake disks, such as disks made of carbon/carbon (C/C) composite material for airplane brakes.

In such a needling machine, a helical fiber sheet for needling is placed on a needling table and is driven in rotation by drive means, usually friction drive means. The feed for this type of machine may be performed flat on the needling table from a sheet of material for needling that is delivered by an unwinding device that is external to the needling machine.

Document WO 02/088449 discloses a needling machine in which the fiber sheets for needling are fed automatically. For that purpose, the needling machine comprises a storage basket located above the needling table and containing the fiber sheet for needling, a set of conical rollers for continuously extracting the sheet from the storage basket, and a helical chute for taking up the sheet unwound from the storage basket and bringing it to the needling table in register with friction drive means. Nevertheless, that needling machine presents the drawback that the conical rollers for driving the fiber sheet cause the fiber sheet to slip while it is being unwound, thereby deforming the fiber sheet when it reaches the needling table.

OBJECT AND SUMMARY OF THE INVENTION

A main object of the present invention is thus to mitigate such drawbacks by proposing a circular needling machine in which the needling table is fed with fiber sheets automatically and without deforming the sheets.

This object is achieved by a circular needling machine for needling a textile structure formed from a helical fiber sheet, the machine comprising a needling table disposed beneath a feed table for feeding a helical fiber sheet for needling, and wherein, in accordance with the invention, the feed table comprises a circular belt conveyor for receiving thereon a helical fiber sheet for needling, the conveyor being centered on a vertical axis and having a radial slot opening out under the circular conveyor to unwind continuously the fiber sheet received on the conveyor, the slot opening out under the conveyor towards a substantially straight chute that extends vertically between the conveyor and a support tray of the needling table centered on the vertical axis of the conveyor so as to take up the sheet unwound from the conveyor and bring it onto the needling table, said support tray having means for driving the fiber sheet in rotation about the vertical axis.

The presence of a circular conveyor makes it possible to deliver the fiber sheet without tension, the sheet then being guided vertically towards the needling table by means of the chute. Thus, no deformation appears in the fiber sheet before it is needled. In addition, compared with a helical chute, the presence of a chute that is substantially straight makes it possible to save space for positioning other functions of the machine (such as engaging the fiber sheet and automatically cutting it).

In an advantageous provision, the needling table further includes a guide tray centered on the vertical axis and movable vertically relative to the support tray between a low, operating position in which it rests on said support tray, and a raised, disengaged position in which it is positioned above said support tray.

Under such circumstances, the chute has one portion secured to the feed table and another portion secured to the guide tray of the needling table, these portions being suitable for moving in translation one inside the other during the vertical movements of the guide tray.

The means for driving the fiber sheet in rotation may comprise two pairs of conical rollers that are angularly spaced apart from each other and that are designed to come into contact with the fiber sheet brought onto the needling table.

A conical presser roller may be secured to the guide tray of the needling table and may be placed at the outlet from the chute.

The feed table may further include a roller placed under the circular conveyor and angularly interposed between the slot and the inlet of the chute so as to enable a free end of the sheet being unwound from the conveyor to be taken up and guided towards the chute.

Means may be provided for removing the textile structure from the support of the needling table, said means advantageously comprising a manipulator arm provided with a hinged finger for taking hold of and removing the textile structure. Cutter means for cutting the fiber sheet may also be provided.

Preferably, the circular conveyor of the feed table has two curved conveyor portions, each in the form of a half-disk and disposed facing the other, the slot being formed by a gap left between the two conveyor portions.

BRIEF DESCRIPTION OF THE DRAWINGS

Other characteristics and advantages of the present invention appear from the following description made with reference to the accompanying drawings which show an embodiment having no limiting character. In the figures.

DETAILED DESCRIPTION OF AN EMBODIMENT

Figure 1:
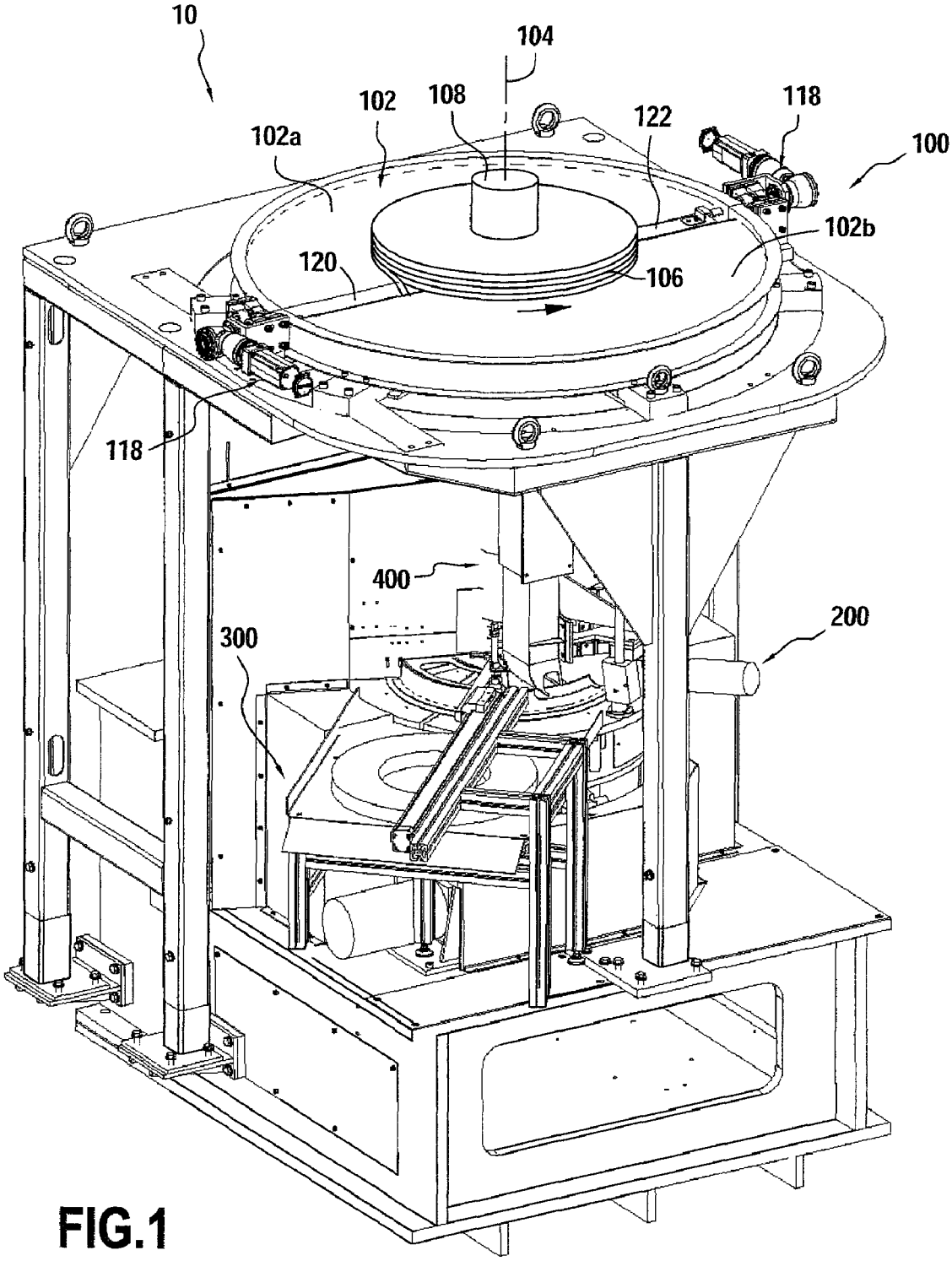
FIG. 1 is an overall perspective view of a circular needling machine of the invention.

FIG. 1 is a diagrammatic view of a circular needling machine 10 of the invention. The machine is for needling an annular textile structure or preform made from a helical fiber sheet (or strip).

The needling machine 10 comprises a feed table 100 for feeding fiber sheet for needling, a needling table 200 placed under the feed table and a removal table 300 for removing the needled structure from the needling table.

The feed table 100 for feeding the fiber sheet for needling comprises a circular conveyor 102 centered on a vertical axis 104 and receiving thereon a fiber sheet 106 for needling. The fiber sheet is more precisely wound as a plurality of layers around a central cylinder 108 centered on the vertical axis 104, and it is driven to rotate about said axis by the circular conveyor.

Figure 2:
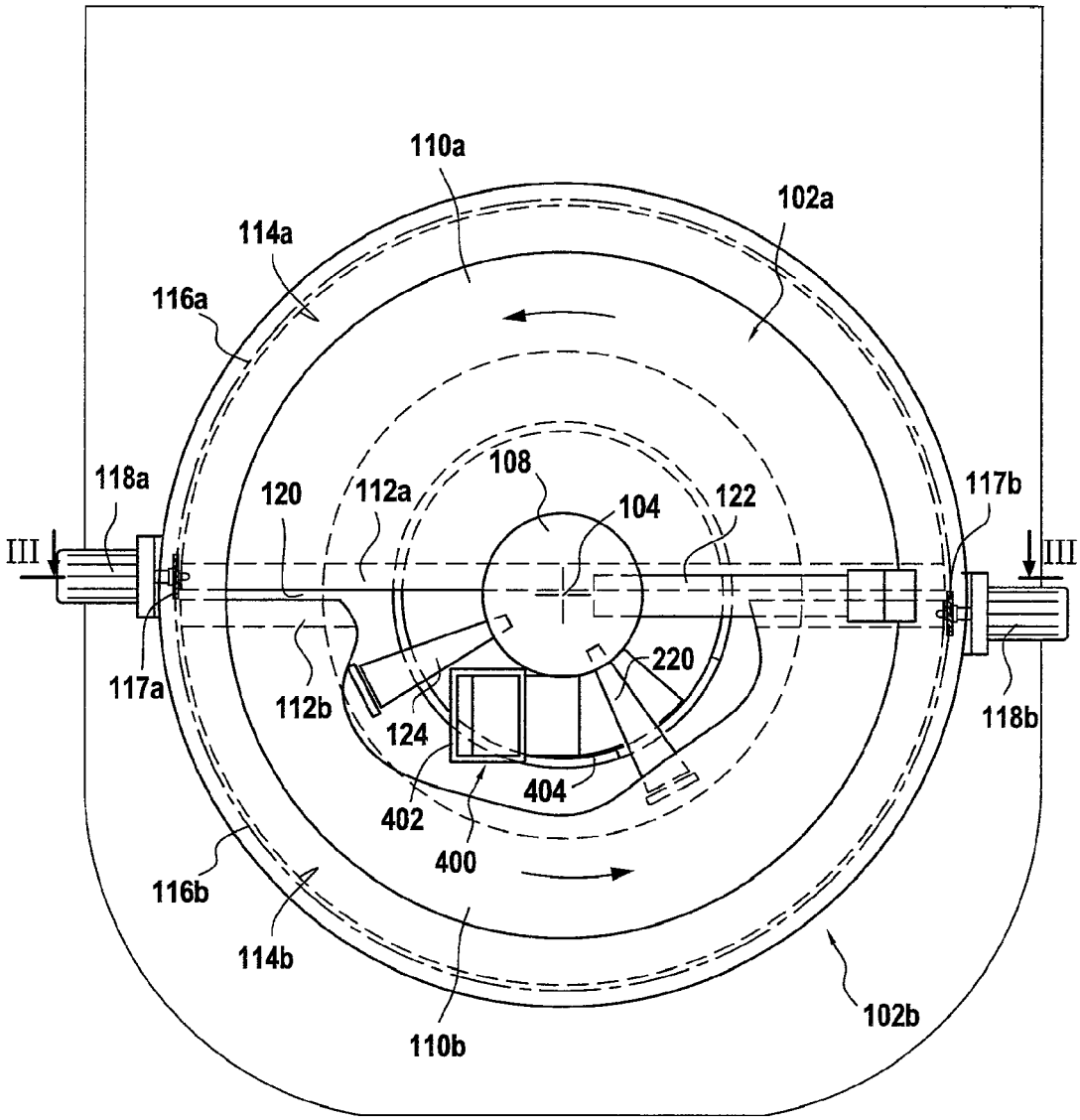
FIG. 2 is a partially cut-away diagrammatic plan view of the feed table of the FIG. 1 needling machine.
Figure 3:
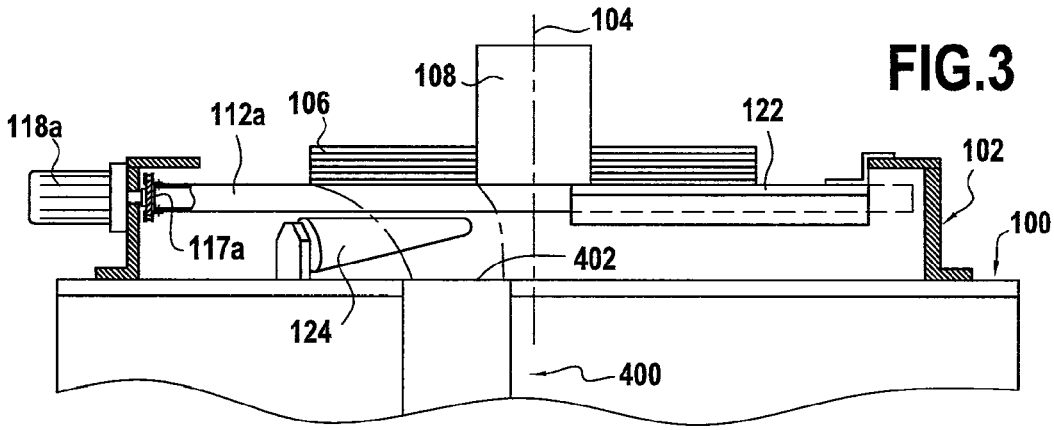
FIG. 3 is a section view on III-III of FIG. 2.

As shown in FIGS. 1 to 3, the circular conveyor 102 of the feed table comprises, more specifically, two curved conveyor portions 102*a* and 102*b*, each in the form of a half-disk that is disposed facing the other half-disk (the straight edges of these conveyor portions being parallel and facing each other). The direction of rotation of these curved conveyor portions is directed in such a manner as to cause the fiber sheet 106 to form a complete 360° revolution around the vertical axis 104.

Each curved conveyor portion 102*a*, 102*b* thus serves to perform a 180° half-revolution of the fiber sheet 106. For this purpose, and in known manner, each curved conveyor portion comprises a looped (or endless) belt 110*a*, 110*b* that is tensioned around a stationary cylindrical bar 112*a*, 112*b* of horizontal axis causing it to follow a semicircular trajectory. The curved edge 114*a*, 114*b* of said looped belt is secured to a looped chain 116*a*, 116*b* (or the like) suitable for following a semicircular trajectory. This looped chain is tensioned between two sprocket wheels 117*a*, 117*b* on the same axis as the cylindrical bar 112*a*, 112*b*, one of these sprocket wheels being rotated by a motor 118*a*, 118*b*. The motors 118*a*, 118*b* are synchronized so as to cause both looped belts of the curved conveyor portions to move at the same speed of rotation.

The curved conveyor portions 102*a*, 102*b* are spaced apart from each other so as to leave between them a radial slot 120 to allow the fiber sheet 106 positioned on the circular conveyor to be unwound. A plate 122 covers about half of this gap between the curved conveyor portions.

The radial slot 120 opens out under the circular conveyor 102 of the feed table into a substantially straight chute 400 that extends vertically between the circular conveyor and the needling table 200. The function of this chute is to take the sheet 106 that is being unwound from the conveyor and to guide it vertically onto the needling table.

For this purpose, and as shown in FIG. 2, the inlet 402 to the chute 400 is angularly offset (in the direction of rotation of the circular conveyor 102) a little relative to the slot 120. Advantageously, a conical roller 124 is placed in the circular conveyor 102 to which it is connected and is interposed angularly between the slot 102 and the inlet 402 of the chute 400. This roller thus enables a free end of the fiber sheet 106 unwound from the conveyor to be taken up and guided towards the inlet of the chute.

Figure 4:
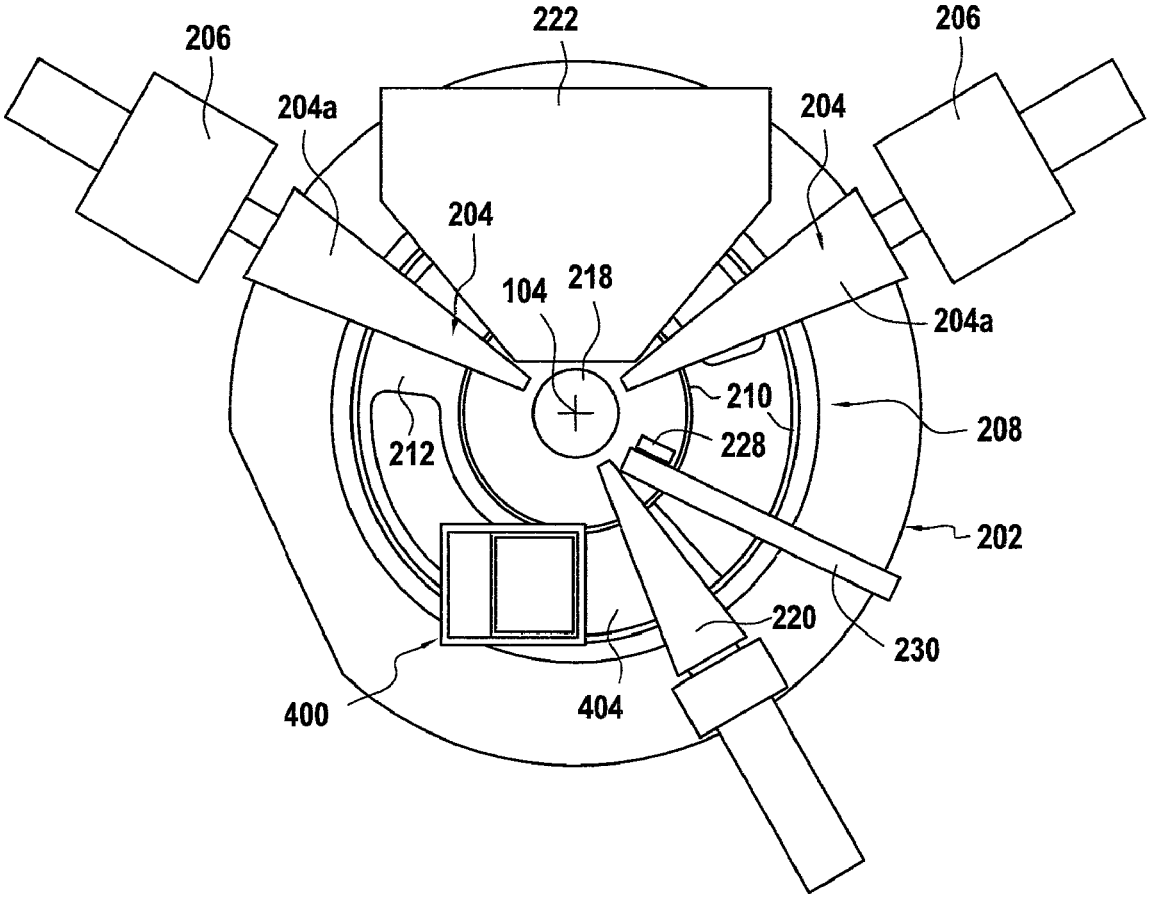
FIG. 4 is a diagrammatic plan view of the needling table of the FIG. 1 needling machine.

The straight chute 400 is in the form of a hollow tubular duct extending vertically from its inlet 402 that opens out beneath the circular conveyor 102 to its curved outlet 404 of shape that matches the curvilinear profile of a support tray 202 of the needling table (see FIG. 4). This tray is centered on the vertical axis 104 and receives the fiber sheet brought by the chute from the feed table.

The fiber sheet brought in this way onto the support tray 204 is driven in rotation about the vertical axis 104 in the same direction of rotation as the circular conveyor so as to pass under a needling head, as described below. For this purpose, rotary drive means for the fiber sheet comprise two (or more) pairs of conical rollers that are angularly spaced apart from one another. Each pair of rollers 204 comprises a conical roller 204*a* forming a presser roller continuously in contact with the fiber sheet, and a conical backing roller 204*b* placed in an opening in the support tray facing the presser roller 204*a* so that the fiber sheet is sandwiched between them. More precisely, the support tray is perforated so that the backing rollers 204*b* come directly into contact with the fiber sheet that is placed on the tray.

The presser rollers 204*a* are driven in rotation, e.g. each by means of respective independent gearmotor units 206 controlled by control means (not shown). The backing rollers 204*b* may be free to rotate or they may optionally be driven. The control means serve in particular to synchronize the speeds of rotation of the various rollers. Naturally, other conventional rotary drive and synchronization means could be envisaged for the rollers.

The needling table also has a guide tray 208 in the form of two annular walls 210 centered on the vertical axis 104 and extending vertically from the support tray 202. These vertical walls are connected together by lateral reinforcements 212 and they serve to provide lateral guidance of the fiber sheet while it is rotating about the vertical axis.

Figure 5A:
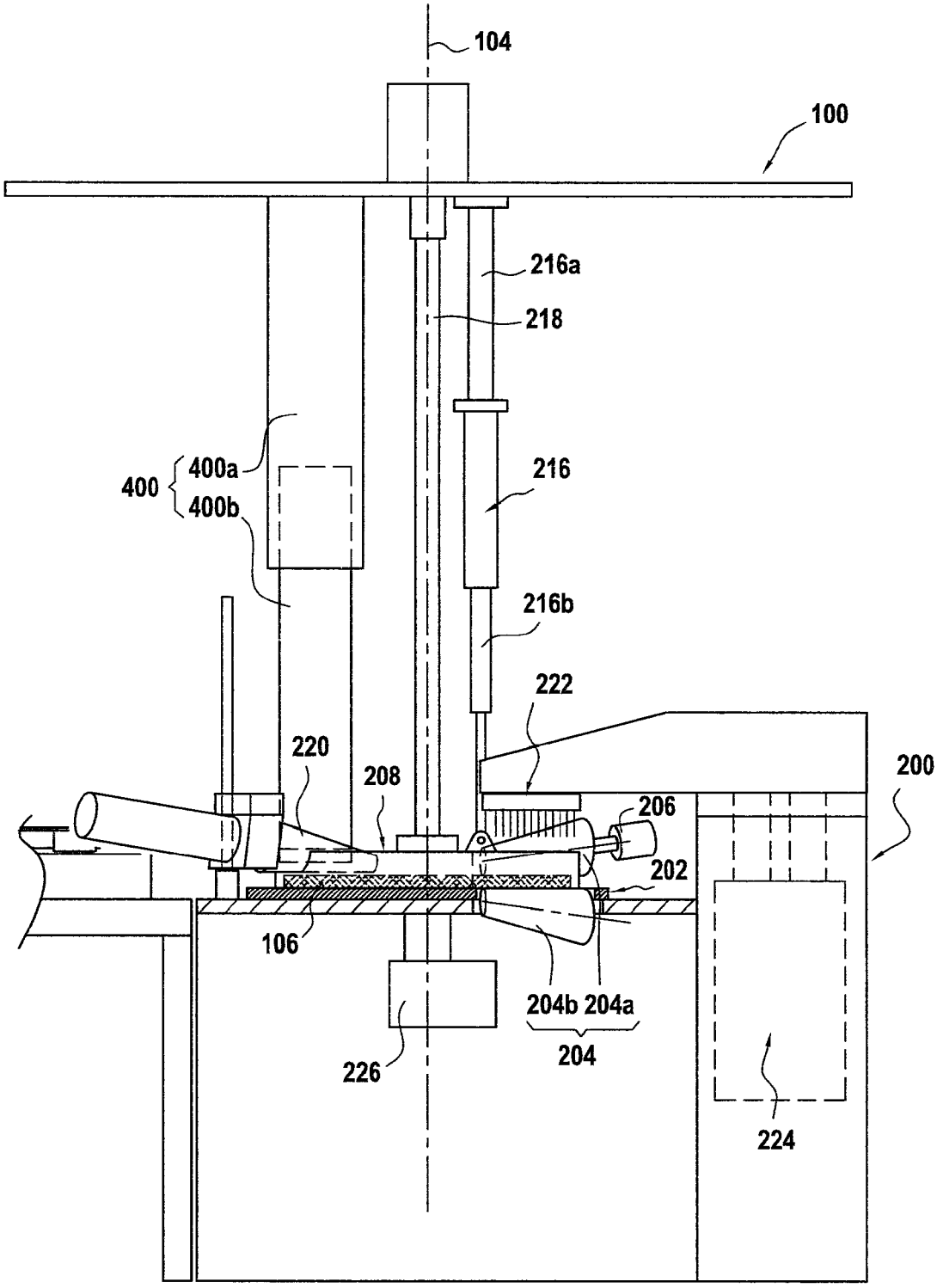
FIGS. 5A and 5B are diagrammatic views showing the needling table of the FIG. 1 needling machine in two different positions.
Figure 5B:
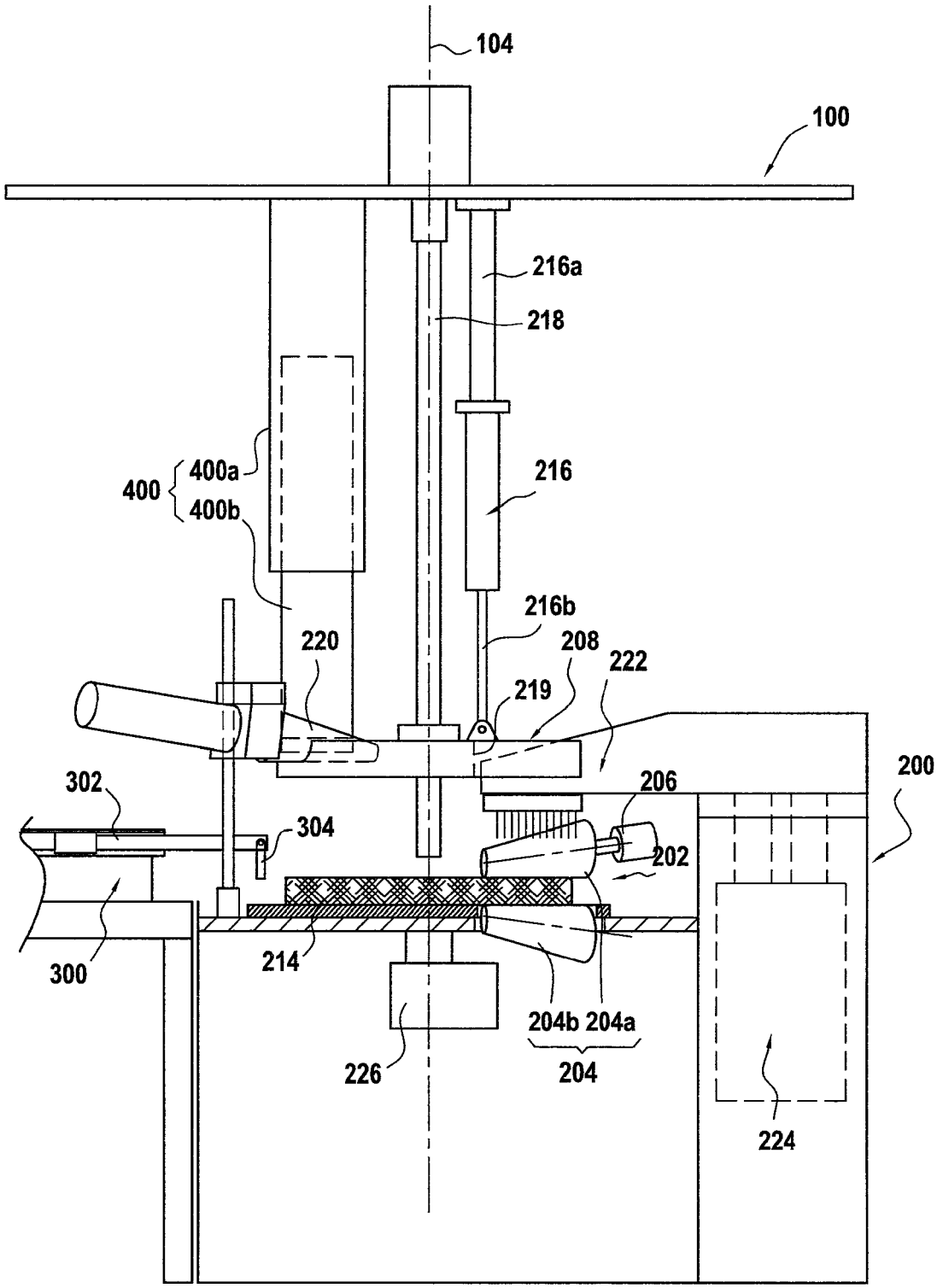

In an advantageous configuration, the guide tray is movable vertically relative to the support tray 202 between a low, operating position in which it rests on said support tray to provide lateral guidance for the fiber sheet 106 (FIG. 5A) and a raised, disengaged position in which it is positioned above said support tray (FIG. 5B). In the raised position of the guide tray 208, the textile structure 214 formed from the needled fiber sheet may easily be removed onto the removal table 300 by removal means that are described in greater detail below.

The vertical movement of the guide tray 208 is provided, by way of example, by means of an actuator 216 having its cylinder 216*a* secured to the feed table 100 and its rod 216*b* fastened to the guide tray. The actuator is actuated by control means (not shown). The guide tray is raised in translation about a bar 218 centered on the vertical axis 104 and fastened to the feed table.

Furthermore, this vertical movement is made possible because the chute 400 presents one portion 400*a* that is secured to the feed table 100 and another portion 400*b* that is secured to the guide tray 208 of the needling table, these two portions 400*a*, 400*b* being suitable for moving in translation one inside the other during movements of the guide tray (in the example of FIGS. 5A and 5B it is the portion 400*b* secured to the guide tray that moves in translation inside the portion 400*a* secured to the feed table during these movements).

It should be observed that the guide table 208 has an angular cutout 219 corresponding to the shape of the needling head (described below) and allowing the guide tray to pass when it moves vertically.

In another advantageous configuration, the guide tray 208 also has a conical presser roller 220 that is placed at the outlet from the chute 400. This presser roller is positioned more precisely immediately above the fiber sheet when it leaves the chute so as to flatten the fiber sheet correctly before it passes under the needling head. The two pairs of rollers 204 for delivering rotary drive to the fiber sheet and to the presser roller 220 are preferably spaced apart angularly from one another by about 120° (FIG. 4). Furthermore, since the presser roller is secured to the guide tray it is suitable for moving vertically therewith.

The fiber sheet brought onto the support tray is needled by a needling head 222 that has some determined number of barbed needles and that is located vertically above the support tray between the two pairs of conical rollers 204 for delivering rotary drive to the sheet. In known manner, in order to enable the various superposed layers of fiber sheet to be needled to one another, the needling head is driven with vertical reciprocating motion by conventional drive means 224. In addition, the support tray 202 of the needling table is movable vertically under drive from drive means 226 as the needling operation progresses.

Cutter means located upstream from the needling head are also provided for cutting the sheet once a predetermined final thickness has been obtained for the textile structure (sensors that are not shown serve to monitor this thickness accurately as the various layers are superposed one on another). As shown in FIG. 4, these cutter means may comprise a circular knife 228 that is movable radially along a gantry 230 carried by the guide tray 208, the gantry being placed angularly after the presser roller 220 in the direction of rotation of the fiber sheet. Naturally, other cutter means could be envisaged.

Figure 6:
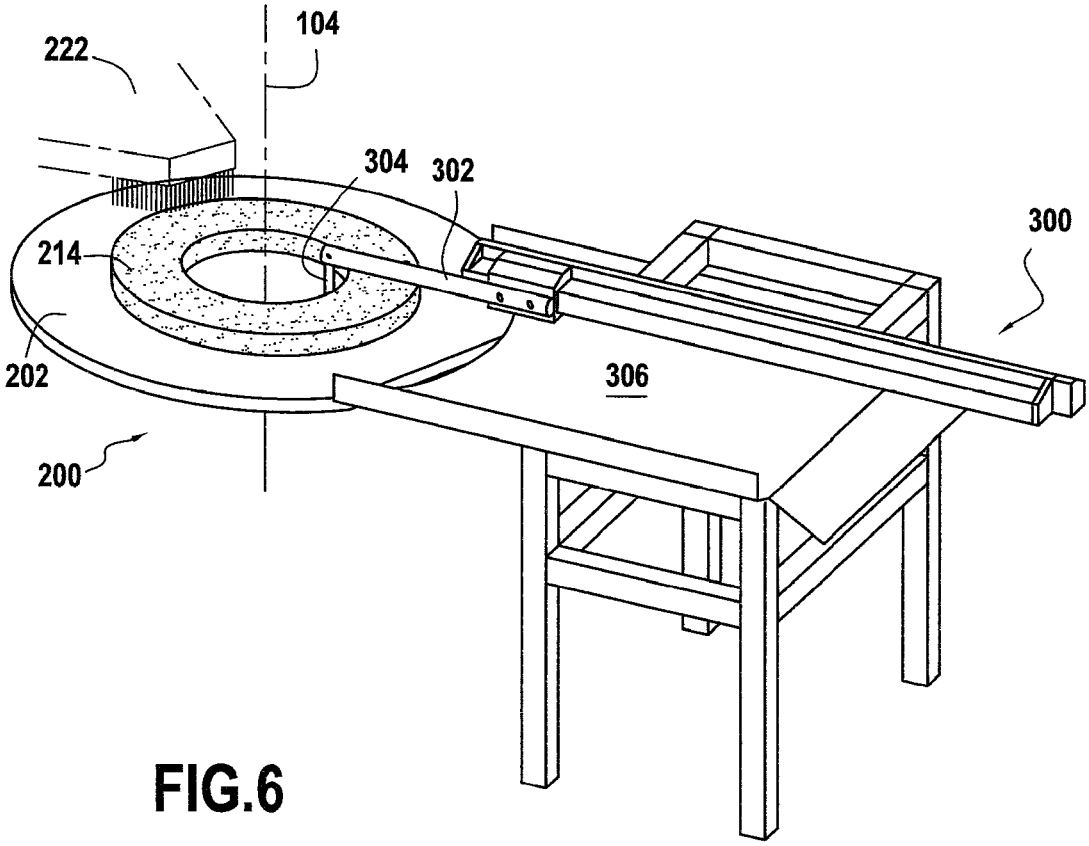
FIG. 6 is a diagrammatic view of the removal table of the FIG. 1 needling machine.

Once the sheet has been cut and the structure has been needled, the removal means shown in FIG. 6 enable the textile structure to be transferred onto the removal table 300 for transfer to another station in the production line such as a heat treatment station. For this purpose, the removal means comprise a manipulator arm 302 extending radially and provided with a hinged finger 304 for taking hold of the textile structure 214 and removing it to a tray 306 of the removal table. This removal operation requires the guide tray of the needling table to be in its raised position as shown in FIG. 5B.

It should be observed that central control means (not shown in the figures) are connected to the motors 118*a*, 118*b* of the curved conveyor portions of the feed table, to the drive means 226 of the support tray 202 of the needling table, to the gearmotor unit 206 of the pairs of conical rollers 204 for driving the fiber sheet in rotation, to the drive means 224 for driving the needling head 222, to the cutter means 228, 230 for cutting the fiber sheet, and to the removal means 302, 304 for removing the textile structure. These central control means provide the synchronization and control that are needed for obtaining a continuous needling process.

What is claimed is:

1. A circular needling machine for needling a textile structure formed from a helical fiber sheet, the machine comprising a needling table disposed beneath a feed table for feeding a helical fiber sheet for needling, wherein the feed table comprises a circular belt conveyor for receiving thereon a helical fiber sheet for needling, the conveyor being centered on a vertical axis and having a radial slot opening out under the circular conveyor to unwind continuously the fiber sheet received on the conveyor, the slot opening out under the conveyor towards a substantially straight chute that extends vertically between the conveyor and a support tray of the needling table centered on the vertical axis of the conveyor so as to take up the sheet unwound from the conveyor and bring it onto the needling table, said support tray having means for driving the fiber sheet in rotation about the vertical axis.

2. A machine according to claim 1, wherein the needling table further includes a guide tray centered on the vertical axis and movable vertically relative to the support tray between a low, operating position in which it rests on said support tray, and a raised, disengaged position in which it is positioned above said support tray.

3. A machine according to claim 2, wherein the chute has one portion secured to the feed table and another portion secured to the guide tray of the needling table, these portions being suitable for moving in translation one inside the other during the vertical movements of the guide tray.

4. A machine according to claim 1, wherein the means for driving the fiber sheet in rotation comprise two pairs of conical rollers that are angularly spaced apart from each other and that are designed to come into contact with the fiber sheet brought onto the needling table.

5. A machine according to claim 1, further comprising a conical presser roller secured to the guide tray of the needling table and placed at the outlet from the chute.

6. A machine according to claim 1, wherein the feed table further includes a roller placed under the circular conveyor and angularly interposed between the slot and the inlet of the chute so as to enable a free end of the sheet being unwound from the conveyor to be taken up and guided towards the chute.

7. A machine according to claim 1, further including means for removing the textile structure from the support tray of the needling table.

8. A machine according to claim 7, wherein the means for removing the textile structure comprise a manipulator arm provided with a hinged finger for taking hold of and removing the textile structure.

9. A machine according to claim 1, wherein the needling table further comprises cutter means for cutting the fiber sheet.

10. A machine according to claim 1, wherein the circular conveyor of the feed table has two curved conveyor portions, each in the form of a half-disk and disposed facing the other, the slot being formed by a gap left between the two conveyor portions.

* * * * *